US008393746B2

(12) United States Patent
Lee

(10) Patent No.: US 8,393,746 B2
(45) Date of Patent: Mar. 12, 2013

(54) LIGHTING DEVICE FOR REFRIGERATOR AND A METHOD OF CONTROLLING THE SAME

(75) Inventor: Bong-Kook Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 570 days.

(21) Appl. No.: 12/600,767

(22) PCT Filed: May 13, 2008

(86) PCT No.: PCT/KR2008/002651

§ 371 (c)(1),
(2), (4) Date: Nov. 18, 2009

(87) PCT Pub. No.: WO2008/147058

PCT Pub. Date: Dec. 4, 2008

(65) Prior Publication Data

US 2010/0149786 A1 Jun. 17, 2010

(30) Foreign Application Priority Data

May 25, 2007 (KR) ..... 10-2007-0050627
Sep. 14, 2007 (KR) ..... 10-2007-0093568

(51) Int. Cl.
*F21V 33/00* (2006.01)

(52) U.S. Cl. ..... 362/92; 632/94; 632/249.02

(58) Field of Classification Search ..... 362/92, 362/94, 125, 127, 133, 155, 249.02, 249.06, 362/276, 374, 375, 800; 62/252, 264, 440
See application file for complete search history.

(56) References Cited

U.S. PATENT DOCUMENTS

| | | | | |
|---|---|---|---|---|
| 5,056,332 | A * | 10/1991 | Tajima et al. | 62/252 |
| 7,338,180 | B2 * | 3/2008 | Wing | 362/92 |
| 7,640,757 | B2 * | 1/2010 | Lee | 62/129 |
| 8,021,009 | B2 * | 9/2011 | Knoll et al. | 362/92 |
| 8,037,706 | B2 * | 10/2011 | Gorz et al. | 62/275 |
| 2007/0223226 | A1 * | 9/2007 | Park | 362/267 |
| 2007/0266723 | A1 * | 11/2007 | Lee et al. | 62/264 |

FOREIGN PATENT DOCUMENTS

| | | | |
|---|---|---|---|
| JP | 2006-292221 | A | 10/2006 |
| KR | 10-2006-0007615 | A | 1/2006 |
| KR | 10-2006-0071660 | A | 6/2006 |

* cited by examiner

*Primary Examiner* — Hargobind S Sawhney
(74) *Attorney, Agent, or Firm* — Birch, Stewart, Kolasch & Birch, LLP

(57) ABSTRACT

Provided is a lighting device for a refrigerator. A cold air duct is disposed at a rear surface of a storage room of the refrigerator, and the lighting device is disposed at the cold air duct for illuminating the storage room. Therefore, the storage capacity of the refrigerator does not decrease by the lighting device, and the efficiency of the refrigerator can increase. In addition, a user is not dazzled by light emitted from the lighting device.

18 Claims, 5 Drawing Sheets

LIGHTING DEVICE FOR REFRIGERATOR AND A METHOD OF CONTROLLING THE SAME

TECHNICAL FIELD

The embodiments relates to a refrigerator, and more particularly, to a lighting device for illuminating a storage room of a refrigerator and a method of controlling the lighting device.

BACKGROUND ART

Refrigerators are home appliances that provide a storage room kept at a temperature lower than the room temperature. Food can be kept cold or frozen in the storage room for long time.

In general, a refrigerator includes a freezer compartment and a refrigerator compartment. For example, various foods can be kept cold in the refrigerator compartment.

A lighting device may be disposed in the refrigerator for illuminating a storage room of the refrigerator. A door switch may be disposed at a side of a front surface of a main body of the refrigerator for being turned on or off when a door of the refrigerator is opened or closed. The lighting device may be selectively turned on and off according to the on-off operations of the door switch.

The lighting device includes an illumination lamp and a lamp cover. The illumination lamp emits light, and the lamp cover encloses at least a portion of the illumination lamp.

However, the lighting device of the related art has the following disadvantages.

The illumination lamp includes an incandescent bulb as a light source. Incandescent bulb is relatively larger than other light sources such as a light emitting diode (LED). Therefore, the capacity of the storage room of the refrigerator reduces due to the large illumination lamp.

Furthermore, the incandescent bulb generates relatively much heat while emitting light. Thus, food may be inefficiently stored in the refrigerator compartment due to the heat generated by the incandescent bulb.

In addition, the incandescent bulb does not emit directional light. That is, the incandescent bulb emits light radially in all directions. Therefore, when the storage room is opened, light emitted from the illumination lamp can be directly transmitted to a user. Thus, the user may be dazzled by the light emitted from the illumination lamp.

DISCLOSURE OF INVENTION

Technical Problem

Accordingly, the lighting device and the method of controlling the lighting device of the present disclosure is provided to substantially obviate one or more of the problems due to limitations and disadvantages of the related art. Embodiments provide a refrigerator lighting device having an improved structure for preventing a decrease of the storage capacity of a refrigerator.

Embodiments also provide a refrigerator lighting device allowing food to be kept cold in a refrigerator more efficiently.

Embodiments also provide a refrigerator lighting device configured to prevent a user from being dazzled by light emitted from the lighting device.

Technical Solution

A lighting device for a refrigerator according to one embodiment comprises a cold air duct at a side of a storage room of the refrigerator; at least one printed circuit board at a front surface of the cold air duct; at least one light emitting diode (LED) at the printed circuit board, the light emitting diode being configured to emit light in an oblique direction with respect to a front side of the storage room.

A lighting device for a refrigerator according to other embodiment comprises at least one light emitting diode module disposed on a front surface of a cold air duct at a predetermined side of a storage room of the refrigerator, the light emitting diode module being configured to emit light in an oblique direction with respect to a front side of the storage room; at least one light emitting diode cover configured to cover the light emitting diode module and transmit light emitted from the light emitting diode module toward an inside area of the storage room; and at least one reflector at the front surface of the cold air duct, the reflector being configured to reflect light emitted from the light emitting diode module toward the inside area of the storage room.

A lighting device for a refrigerator according to other embodiment comprises a light emitting diode module at a predetermined side of a storage room of the refrigerator, the light emitting diode module being configured to emit light for illuminating the storage room; a light emitting diode cover configured to cover the light emitting diode module; and a blocking portion disposed at the light emitting diode cover for blocking light emitted from the light emitting diode module toward a front side of the storage room.

A lighting device for a refrigerator according to other embodiment comprises a light emitting diode module at a predetermined side of a storage room of the refrigerator, the light emitting diode module being configured to emit light for illuminating the storage room; a light emitting diode cover configured to cover the light emitting diode module; and a scattering portion disposed at the light emitting diode cover for scattering light emitted from the light emitting diode module toward a front side of the storage room.

A method of controlling a lighting device for a refrigerator according to one embodiment comprises allowing a door switch to be turned on when a storage room of the refrigerator is opened; allowing a controller to turn on the light emitting diode of the lighting device of any one of claims 1 to 6 such that the light emitting diode emits light with a gradually increasing brightness for a preset time period after the switch is turned on; allowing the door switch to be turned off when the storage room is closed; and allowing the controller to turn off the light emitting diode when the door switch is turned off.

A method of controlling a lighting device for a refrigerator according to the other embodiment comprises allowing a door switch to be turned on when a storage room of the refrigerator is opened; allowing a controller to turn on the light emitting diode of the lighting device of any one of claims 1 to 6 after a preset time period from the turning-on of the switch; allowing the door switch to be turned off when the storage room is closed; and allowing the controller to turn off the light emitting diode when the door switch is turned off.

Advantageous Effects

According to embodiments, the refrigerator lighting device provides the following advantageous effects.

Since the lighting device uses a light emitting diode (LED) as a light source instead of using a lamp with an incandescent bulb, the lighting device occupies less space of a storage room of a refrigerator, thereby increasing the storage capacity of the refrigerator.

In addition, the LED of the lighting device generates relatively less heat when it emits light. Therefore, food stored in the storage room of the refrigerator is less affected by heat generated from the lighting device, and thus the food can be kept fresh.

Moreover, light emitted from the LED is not directly directed to a user through an opened front side of the storage room. Therefore, when a user places food into the storage room or takes food out of the storage room, the user is not dazzled by light emitted from the LED. That is, users can use the refrigerator more conveniently.

MODE FOR THE INVENTION

Reference will now be made in detail to the embodiments of the present disclosure, examples of which are illustrated in the accompanying drawings. The present disclosure may, however, be embodied in many different forms and should not be construed as being limited to the embodiments set forth herein.

Figure 1:
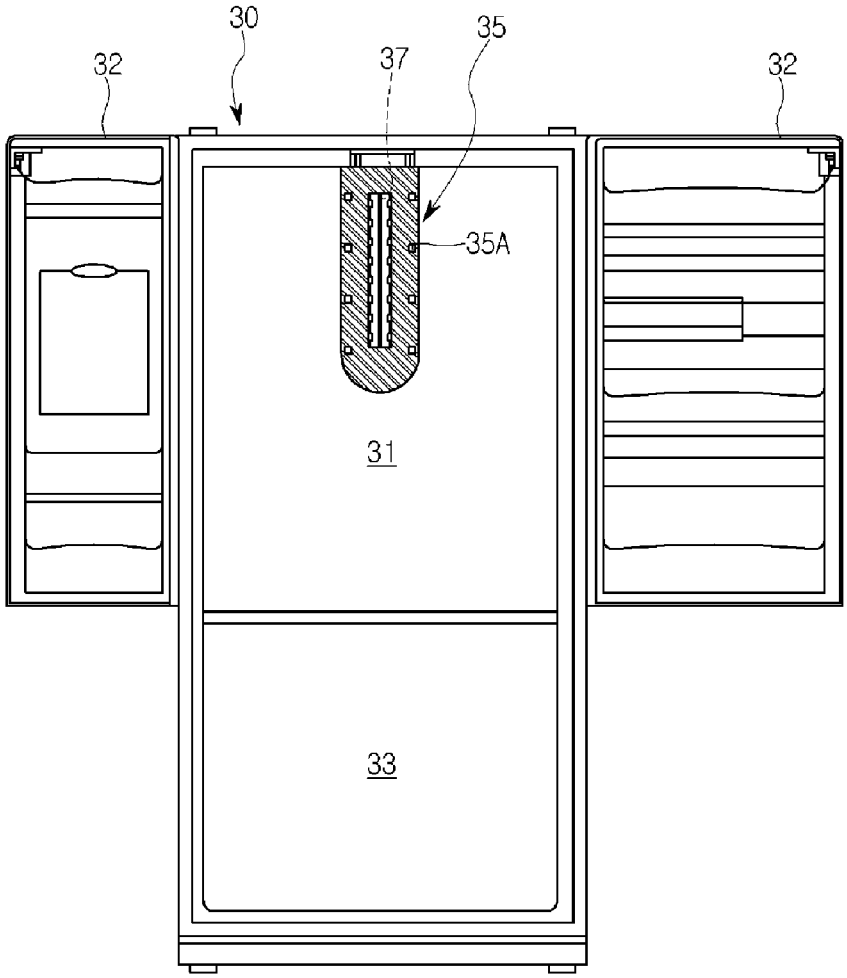
FIG. 1 is a front view illustrating the inside of a refrigerator including a lighting device according to a first embodiment.
Figure 2:
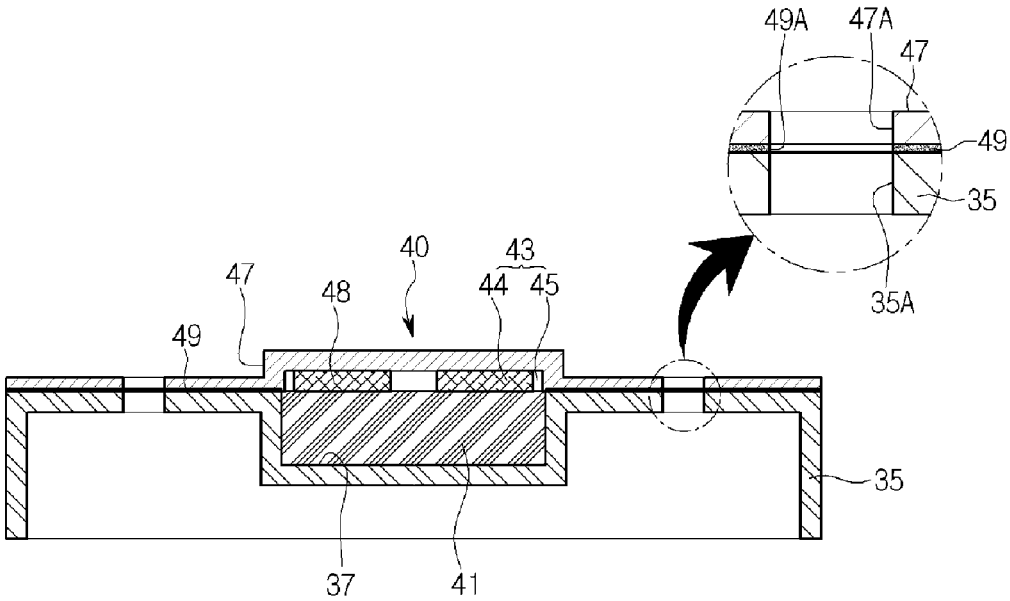
FIG. 2 is a cross-sectional view illustrating a portion of the refrigerator of FIG. 1.

FIG. 1 is a front view illustrating the inside of a refrigerator including a lighting device 40 according to a first embodiment, and FIG. 2 is a cross-sectional view illustrating a portion of the refrigerator of FIG. 1.

Referring to FIGS. 1 and 2, in the current embodiment, a storage room is disposed in a refrigerator main body 30. The storage room is divided into an upper refrigerator compartment 31 and a lower freezer compartment 33. The refrigerator compartment 31 can be selectively closed and opened using a pair of refrigerator doors 32. The refrigerator doors 32 are hinged on the refrigerator main body 30 such that the refrigerator doors 32 can be rotated back and forth. The freezer compartment 33 can be opened and closed like a drawer by using a freezer door (not shown).

A cold air duct 35 is disposed in a rear center portion of the refrigerator compartment 31. The cold air duct 35 allows cold air to flow from the freezer compartment 33 to the refrigerator compartment 31. The cold air duct 35 has a rectangular plate shape having a predetermined length.

The cold air duct 35 includes a plurality of cold air outlets 35A. The cold air outlets 35A are vertically arranged at both sides of the cold air duct 35 and are spaced a predetermined distance apart from each other. Cold air flowing in the cold air duct 35 is introduced into the refrigerator compartment 31 through the cold air outlets 35A.

An installation groove 37 is formed in a front center portion of the cold air duct 35. The installation groove 37 may be formed by recessing the front center portion of the cold air duct 35 into a vertically elongated shape. Substantially, the installation groove 37 is disposed between the cold air outlets 35A arranged at both sides of the cold air duct 35. An installation member 41 (described later) is fixed to the installation groove 37.

The lighting device 40 is disposed at a front surface of the cold air duct 35 exposed to the front of the refrigerator compartment 31. The lighting device 40 selectively illuminates the refrigerator compartment 31 according to opening/closing operations of the refrigerator doors 32. For this, the lighting device 40 is selectively turned on and off by a door switch (not shown). The door switch is turned on and off according to rotation of the refrigerator doors 32. The lighting device 40 includes the installation member 41, a pair of light emitting diode (LED) modules 43, an LED cover 47, and a reflection sheet 49.

The installation member 41 is fixed to the installation groove 37. The installation member 41 is used to fix the LED modules 43. The installation member 41 may be formed of a synthetic resin by injection molding. The installation member 41 may have a shape corresponding to the shape of the installation groove 37.

The LED modules 43 emit light for illuminating the inside of the refrigerator compartment 31. The LED modules 43 are disposed at both sides of the installation member 41, respectively. Each of the LED modules 43 includes a printed circuit board 44 and a plurality of LEDs 45. The printed circuit board 44 may be a metal printed circuit board.

When the installation member 41 is fixed to the installation groove 37, the LED modules 43 protrude above the front surface of the cold air duct 35 toward the front of the refrigerator compartment 31.

The printed circuit board 44 is fixed to a front surface of the installation member 41. The printed circuit board 44 may be formed of a surface-treated aluminum substrate. In this case, when the LEDs 45 are turned on, heat generated from the LEDs 45 can be dissipated more efficiently.

The LEDs 45 are light sources for emitting light. The LEDs 45 are disposed at an edge portion of the front side of the printed circuit board 44. The LEDs 45 may be spaced apart from each other.

When the installation member 41 on which the LED modules 43 are installed is fixed to the installation groove 37, the LEDs 45 are arranged on the printed circuit boards 44 to face both sides of the refrigerator compartment 31. Therefore, light may be emitted from the LEDs 45 toward both sides of the refrigerator compartment 31.

The LED cover 47 covers the front surface of the cold air duct 35 where the LED modules 43 are installed and transmits light emitted from the LEDs 45 toward the inside of the refrigerator compartment 31. The LED cover 47 includes a plurality of cold air holes 47A corresponding to the cold air outlets 35A.

Therefore, cold air can flow from the cold air duct 35 into the refrigerator compartment 31 through the cold air outlets 35A and the cold air holes 47A.

An accommodation groove 48 corresponding to the LED modules 43 is formed in a center portion of a rear surface of the LED cover 47. The accommodation groove 48 is formed by recessing a portion of the LED cover 47 away from the installation groove 37. When the LED cover 47 is disposed in place to cover the front surface of the cold air duct 35, the LED modules 43 are stably accommodated in the accommodation groove 48.

In other words, when the rear surface of the LED cover 47 is brought into tight contact with the front surface of the cold air duct 35 for covering the front surface of the cold air duct 35 with the LED cover 47, the LED modules 43 is stably accommodated in the accommodation groove 48.

The reflection sheet 49 is disposed between the cold air duct 35 and the LED cover 47 so as to reflect light emitted from the LEDs 45 toward the front of the refrigerator compartment 31. The reflection sheet 49 includes a plurality of penetration holes 49A corresponding to the cold air outlets 35A and the cold air holes 47A. The reflection sheet 49 does not overlap the LED modules 43. That is, the reflection sheet 49 disposed between the cold air duct 35 and the LED cover 47 does not overlap the installation groove 37 and the accommodation groove 48.

The structure and operation of the lighting device 40 for a refrigerator will now be described according to embodiments.

First, it will now be described how the lighting device 40 is installed according to an embodiment.

The reflection sheet 49 is attached to the front surface of the cold air duct 35. Here, the penetration holes 49A of the reflection sheet 49 are aligned with the cold air outlets 35A of the cold air duct 35. Next, the LED modules 43 are installed on the front surface of the installation member 41. Here, the LEDs 45 of the LED modules 43 are arranged along both sides of the installation member 41.

Then, the installation member 41 on which the LED modules 43 are installed is installed in the installation groove 37 of the cold air duct 35. Thereafter, the LED cover 47 is installed to cover the front surface of the cold air duct 35 and the LED modules 43. In this way, the lighting device 40 is completely installed. The lighting device 40 may be installed before or after the cold air duct 35 is installed on a rear surface of the refrigerator compartment 31.

Secondly, it will now be described how the lighting device 40 illuminates the refrigerator compartment 31 according to an embodiment.

The refrigerator compartment 31 may be opened by rotating the refrigerator door 32 to place food into the refrigerator compartment 31 or take food out of the refrigerator compartment 31. If the refrigerator door 32 is rotated and opened, the door switch is turned on, and thus the lighting device 40 is turned on. That is, if the door switch is turned on by the rotation of the refrigerator door 32, the LEDs 45 are turned on to illuminate the inside of the refrigerator compartment 31.

Then, light emitted from the LEDs 45 is directed toward both sides of the refrigerator compartment 31. Therefore, when the refrigerator compartment 31 is opened, a user is not dazzled by light emitted from the LEDs 45. The reflection sheet 49 reflects light emitted from the LEDs 45 toward the front of the refrigerator compartment 31. Thus, although the LEDs 45 are directed toward both sides of the refrigerator compartment 31, the inside of the refrigerator compartment 31 can be uniformly illuminated.

Figure 3:
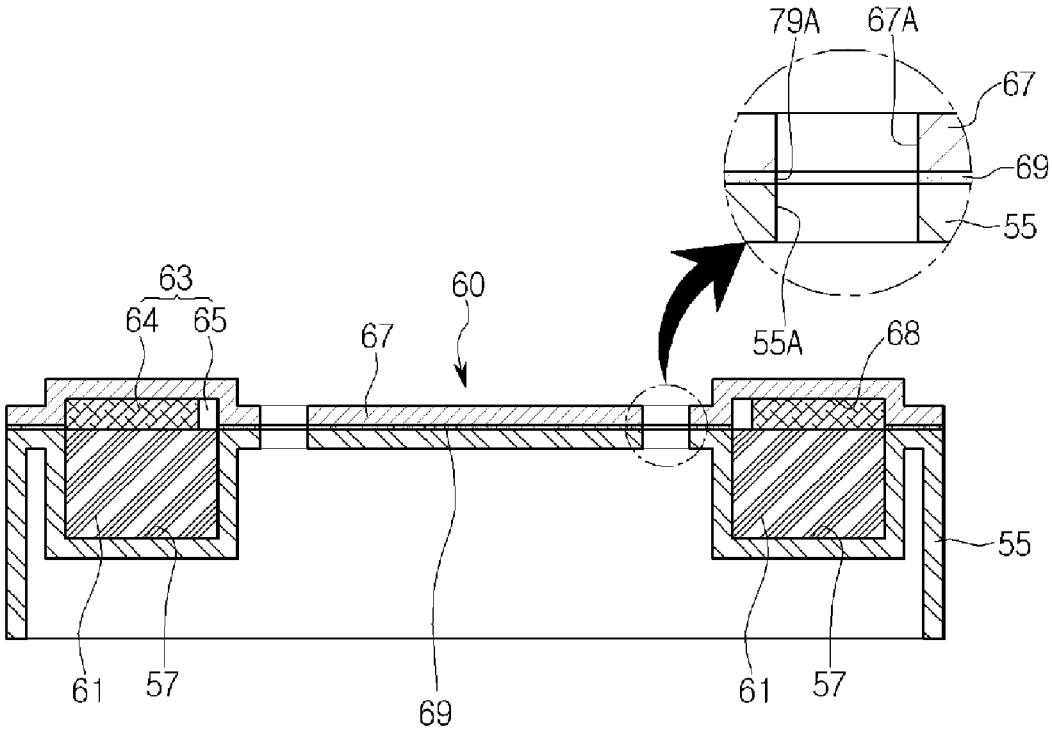
FIG. 3 is a cross-sectional view illustrating a main portion of a refrigerator lighting device according to a second embodiment.
Figure 4:
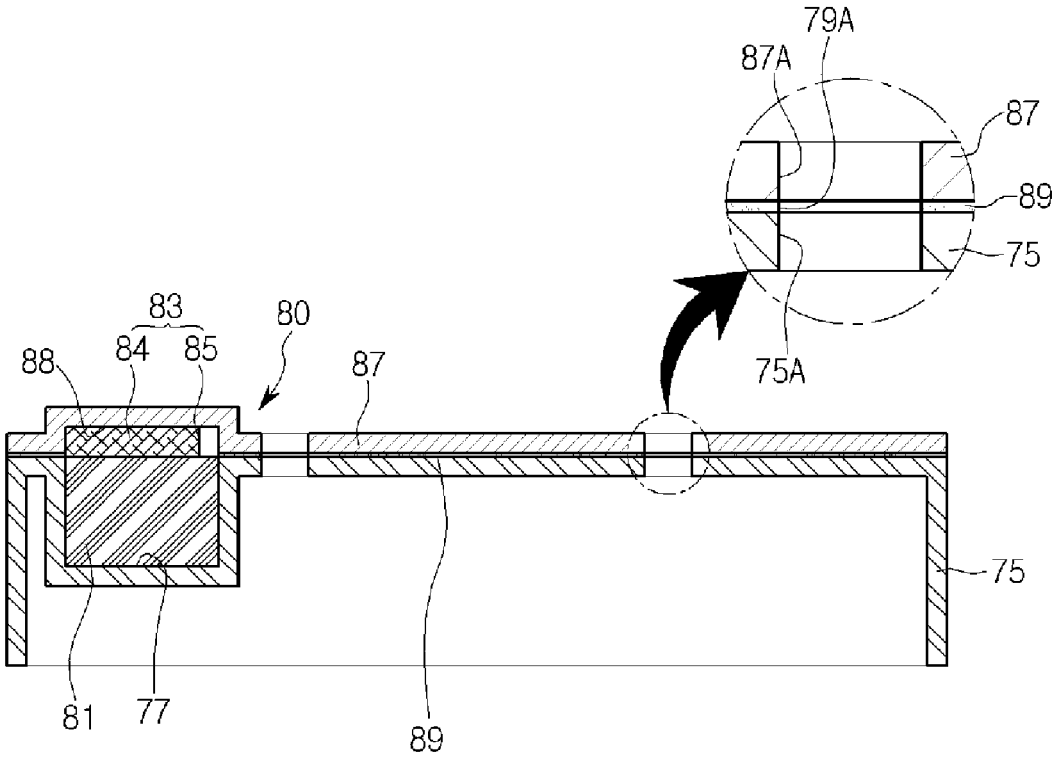
FIG. 4 is a cross-sectional view illustrating a main portion of a refrigerator lighting device according to a third embodiment.

FIG. 3 is a cross-sectional view illustrating a main portion of a refrigerator lighting device according to a second embodiment, and FIG. 4 is a cross-sectional view illustrating a main portion of a refrigerator lighting device according to a third embodiment.

Referring to FIG. 3 in the second embodiment, LED modules 63 are disposed at both sides of a cold air duct 55. For this, installation grooves 57 are formed in both sides of the cold air duct 55, and installation members 61 on which the LED modules 63 are installed are fixed to the installation grooves 57. Thus, light emitted from LEDs 65 of one LED module 63 is directed toward light emitted from LEDs 65 of the other LED module 63.

An LED cover 67 covers a front surface of the cold air duct 55 and the LED modules 63, and a reflection sheet 69 is disposed between the cold air duct 55 and the LED cover 67 to reflect light emitted from LEDs 65 of the LED modules 63. Accommodation grooves 68 corresponding to the installation grooves 57 may be formed in both sides of the LED cover 67 to receive the LED modules 63.

Referring to FIG. 4, in the third embodiment, a single LED module 83 is disposed at a lateral side of a cold air duct 75 using an installation member 81. Thus, only a single installation groove 77 is formed in the lateral side of the cold air duct 75, and only a single accommodation groove 88 corresponding to the installation groove 77 is formed in a lateral side of an LED cover 87. In the embodiment shown in FIG. 4, a reflection sheet 89 may also be disposed between the cold air duct 75 and the LED cover 87 to reflect light.

The lighting device illustrated in FIG. 3 or 4 may be suitable when the refrigerator compartment 31 (refer to FIG. 1) is small. For example, the lighting device of FIG. 3 or 4 may be suitable for a refrigerator divided into a left freezer compartment and a right refrigerator compartment since the lighting device can sufficiently illuminate the refrigerator compartment owing to a narrow width of the refrigerator compartment.

In the above-described embodiments, light emitted from the LEDs is directed to both sides of the storage room, light emitted from the other LEDs, or one side of the storage room. However, the lighting device of the present disclosure is not limited thereto. In other words, a user may not be dazzled if light emitted from the LEDs is directed to the front of the storage room at an oblique angle. For example, light can be emitted from LEDs at an oblique angle of approximately 45° to approximately 135° with respect to the front of the storage room.

Fourth and Fifth embodiments will now be described. In the fourth and fifth embodiments, LED covers having structures different from the structure of the LED cover of the first embodiment are used. Thus, in the following description, the different LED covers will be mainly described, and the same elements as those of the first embodiment will be denoted by the same reference numerals and will not be described again.

Figure 5:
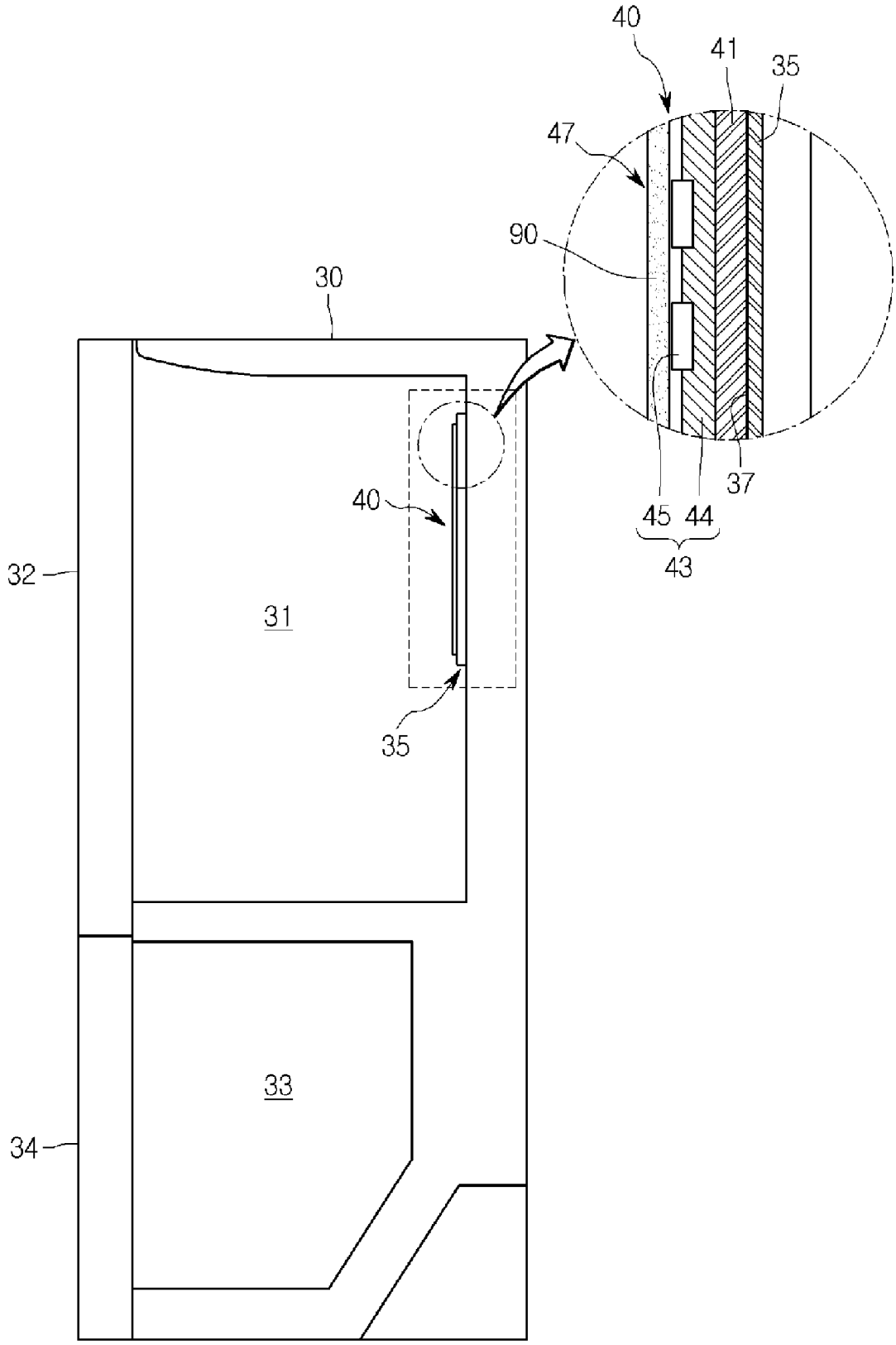
FIG. 5 is a longitudinal sectional view illustrating the inside of a refrigerator including a lighting device according to a fourth embodiment.
Figure 6:
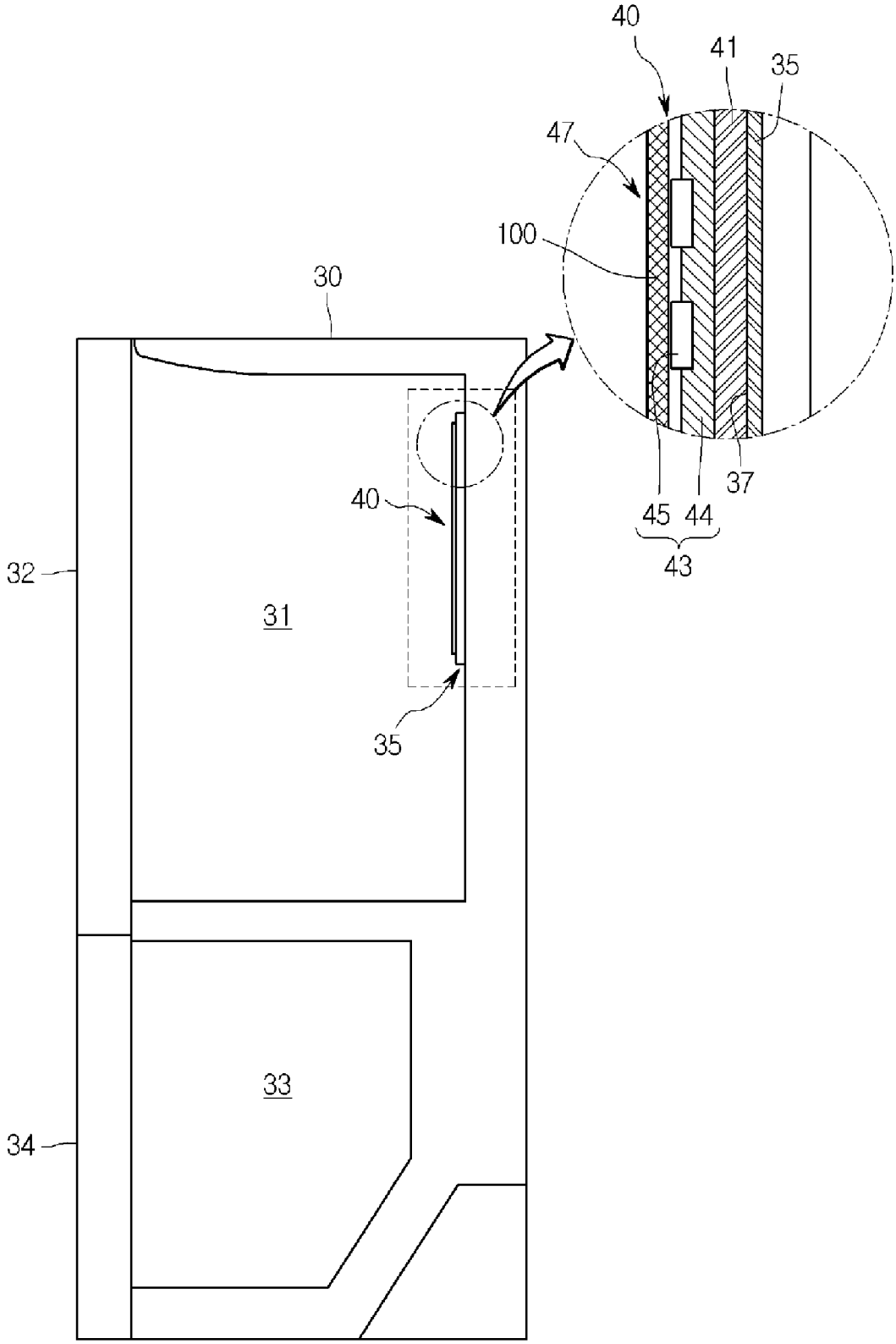
FIG. 6 is a longitudinal sectional view illustrating the inside of a refrigerator including a lighting device according to a fifth embodiment.

FIG. 5 is a longitudinal sectional view illustrating the inside of a refrigerator including a lighting device 40 according to a fourth embodiment, and FIG. 6 is a longitudinal sectional view illustrating the inside of a refrigerator including a lighting device 40 according to a fifth embodiment.

Referring to FIGS. 5 and 6, a cold air duct 35 is disposed in a rear center portion of a refrigerator compartment 31. The cold air duct 35 allows cold air to flow from a freezer compartment 33 to the refrigerator compartment 31. The cold air duct 35 has a rectangular plate shape having a predetermined length. A plurality of cold air outlets (not shown) are formed in both sides of a front surface of the cold air duct 35 to discharge cold air.

As shown in the enlarged portion of FIG. 5, an installation groove 37 is formed in a front center portion of the cold air duct 35. The installation groove 37 may be formed by recessing the front center portion of the cold air duct 35 into a vertically elongated shape. An installation member 41 is fixed to the installation groove 37.

The lighting device 40 is disposed at the front surface of the cold air duct 35. The lighting device 40 includes the installation member 41, LED modules 43, and an LED cover 47. The installation member 41, the LED modules 43, and the LED cover 47 have the same structures and functions as the structures and functions of the installation member 41, the LED modules 43, and the LED cover 47 of the first embodiment.

The LED cover 47 covers the front surface of the cold air duct 35 where the LED modules 43 are installed and transmits light emitted from LEDs 45 of the LED modules 43 toward the inside of the refrigerator compartment 31. For this, the LED cover 47 is formed of a transparent material. The LED cover 47 includes a blocking portion 90. The blocking portion 90 blocks light emitted from the LEDs 45 toward the front of the refrigerator compartment 31 so that a user may not be directly exposed to light. The blocking portion 90 is disposed at a portion of the LED cover 47 that corresponds to the LEDs 45 and is exposed when the refrigerator compartment 31 is opened. That is, the blocking portion 90 is disposed at a portion of a front surface of the LED cover 47.

The blocking portion 90 may be formed by painting the portion of the transparent LED cover 47 with an opaque paint or attaching an opaque sheet to the portion of the transparent LED cover 47. Alternatively, the LED cover 47 may be configured with a transparent region and an opaque region including the blocking portion 90.

The lighting device 40 may further include a reflection sheet (not shown) for reflecting light emitted from the LEDs 45 toward the inside of the refrigerator compartment 31. The reflection sheet may be disposed between the cold air duct 35 and the LED cover 47.

Referring to FIG. 6, in the fifth embodiment, a scattering portion 100 is disposed at an LED cover 47 to scatter light emitted from LEDs 45 of LED modules 43 so as to prevent a user from being directly exposed to light emitted from the LEDs 45 toward the front of a refrigerator compartment 31. The scattering portion 100 may be formed by corroding or patterning a portion of the LED cover 47 corresponding to the LEDs 45. Except for the LED cover 47 including the scattering portion 100, other elements are the same as those of the first embodiment. That is, elements of the current embodiment such as an installation member 41 and LED modules 43 are the same as those of the first embodiment.

A method of controlling a refrigerator lighting device will now be described with reference to FIG. 7.

Figure 7:
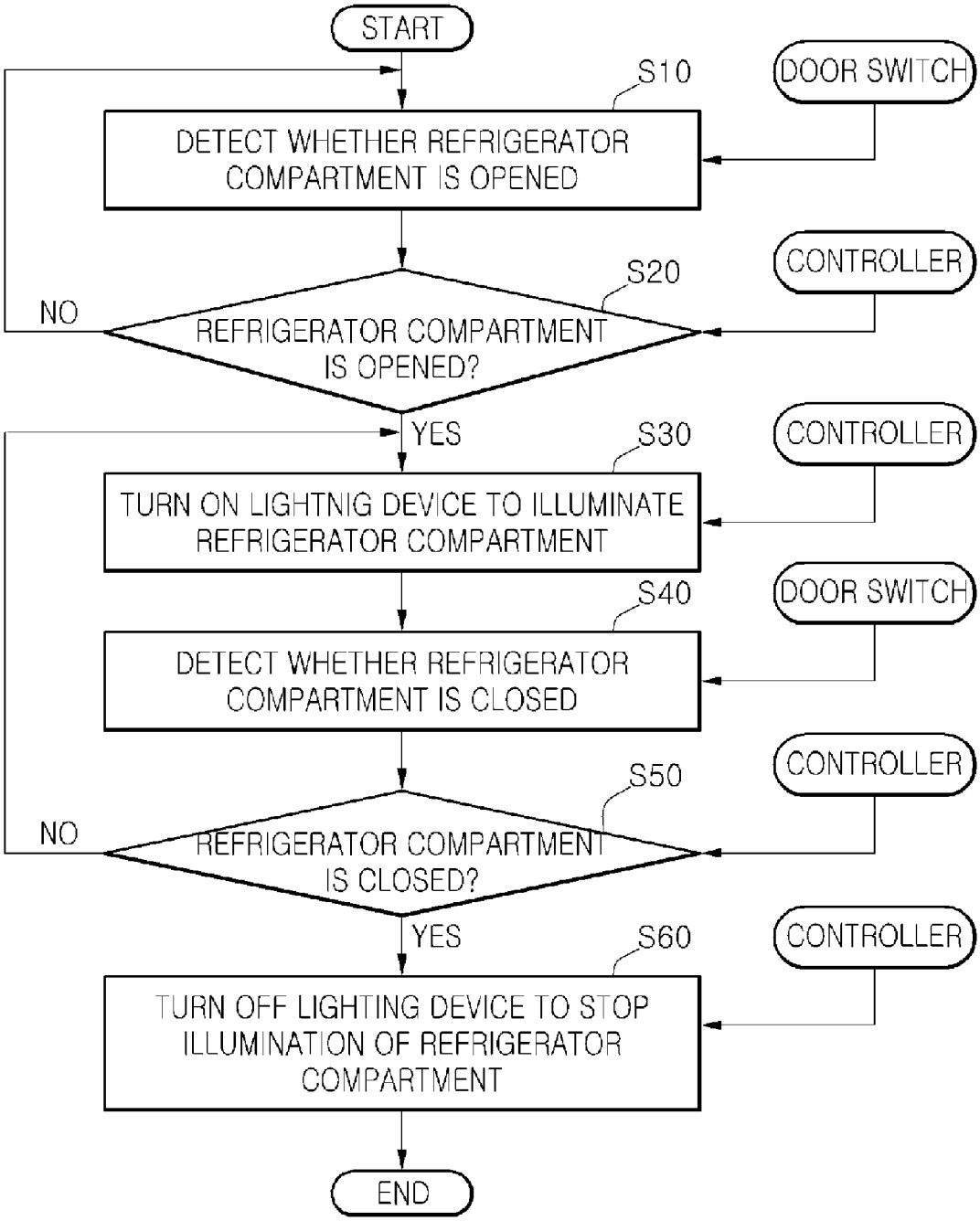
FIG. 7 is a flowchart illustrating a method of controlling on-off operations of a lighting device according to an embodiment.

FIG. 7 is a flowchart illustrating a method of controlling on-off operations of a lighting device according to an embodiment.

Referring to FIG. 7, when the refrigerator door 32 is opened, the door switch is turned on (S10). Then, a controller determines that the refrigerator compartment 31 is opened (S20).

Thereafter, the controller turns on the lighting device 40 to illuminate the refrigerator compartment 31 (S30). Here, owing to the blocking portion 90 or scattering portion 100 of the LED cover 47, a user is not directly exposed to light emitted from the LEDs 45 toward the front of the refrigerator compartment 31. Therefore, the user may not be dazzled by light emitted from the LEDs 45.

In addition, the controller may control the LEDs 45 to emit light with a gradually increasing brightness for a predetermined time period after the refrigerator compartment 31 is opened and the door switch is turned on, in order to prevent a user from being dazzled by the light emitted from the LEDs 45. Alternatively, the controller may control the LEDs 45 to emit light after a preset time. In this case, a user may not be dazzled since light is not immediately emitted from LEDs 45 after the refrigerator compartment 31 is opened. Since light emitted from the LEDs 45 is reflected by the reflection sheet, the refrigerator compartment 31 can be illuminated more efficiently.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A lighting device for a refrigerator, comprising:

a cold air duct disposed in a rear center portion of a storage room of the refrigerator, the cold air duct having a groove formed in a front portion of the cold air duct;

a cover provided at a front side of the groove;

a module interposed between the groove and the cover, wherein the module includes:

at least one printed circuit board at a front surface of the groove;

at least one light emitting diode (LED) at the printed circuit board, the light emitting diode being configured to emit light in an oblique direction with respect to a front side of the storage room; and a reflection sheet disposed between the cover and the cold air duct at one side of the groove to reflect light emitted from the light emitting diode.

2. The lighting device according to claim 1, wherein the light emitting diode emits light in at least one direction except for a direction to the front side of the storage room.

3. The lighting device according to claim 1, wherein the light emitting diode is mounted on the printed circuit board and is oriented such that light emitted from the light emitting diode makes an angle of approximately 45° to approximately 135° with respect to the front side of the storage room.

4. The lighting device according to claim 1, further comprising a blocking portion disposed at the light emitting diode cover for blocking light emitted from the light emitting diode module toward a front side of the storage room.

5. The lighting device according to claim 4, wherein the blocking portion is an opaque portion of the light emitting diode cover oriented toward the front side of the storage room.

6. The lighting device according to claim 1, further comprising a scattering portion disposed at the light emitting diode cover for scattering light emitted from the light emitting diode module toward a front side of the storage room.

7. The lighting device according to claim 6, wherein the scattering portion is formed by patterning a portion of the light emitting diode cover oriented toward the front side of the storage room.

8. The lighting device according to claim 6, wherein the light emitting diode module is disposed at a side of a cold air duct.

9. The lighting device according to claim 8, wherein the light emitting diode module comprises:

at least one printed circuit board at a front surface of the cold air duct; and at least one light emitting diode disposed at the printed circuit board for emitting light.

10. A method of controlling a lighting device for a refrigerator, the method comprising:

allowing a door switch to be turned on when a storage room of the refrigerator is opened;

allowing a controller to turn on the light emitting diode of the lighting device of claim 1, such that the light emitting diode emits light with a gradually increasing brightness for a preset time period after the switch is turned on;

allowing the door switch to be turned off when the storage room is closed; and allowing the controller to turn off the light emitting diode when the door switch is turned off.

11. A method of controlling a lighting device for a refrigerator, the method comprising:

allowing a door switch to be turned on when a storage room of the refrigerator is opened;

allowing a controller to turn on the light emitting diode of the lighting device of claim 1, after a preset time period from the turning-on of the switch;

allowing the door switch to be turned off when the storage room is closed; and allowing the controller to turn off the light emitting diode when the door switch is turned off.

12. A lighting device for a refrigerator, comprising:

at least one light emitting diode module disposed on a front surface of a cold air duct at a predetermined side of a storage room of the refrigerator, the light emitting diode module being configured to emit light in at least one direction with respect to a front side of the storage room;

at least one light emitting diode cover configured to cover the light emitting diode module and transmit light emitted from the light emitting diode module toward an inside area of the storage room; and at least one reflector at the front surface of the cold air duct, the reflector being configured to reflect light emitted from the light emitting diode module toward the inside area of the storage room, wherein the cold air duct comprises a cold air outlet for discharging cold air into the storage room, and the cover member comprises cold air holes corresponding to the cold air outlet.

13. The lighting device according to claim 12, wherein the light emitting diode module is provided in plurality, and light emitted from the light emitting diode modules is directed toward both sides of the storage room.

14. The lighting device according to claim 12, wherein the light emitting diode modules are disposed at both sides of the front surface of the cold air duct, and light emitted from the light emitting diode module disposed at one side faces light emitted from the light emitting diode module disposed at the other side.

15. The lighting device according to claim 12, wherein the light emitting diode module is disposed at an edge portion of the front surface of the cold air duct such that light emitted from the light emitting diode module is directed to a side of the storage room.

16. The lighting device according to claim 12, wherein the light emitting diode module comprises:

a printed circuit board fixed to the front surface of the cold air duct; and at least one light emitting diode disposed at the printed circuit board for emitting light.

17. The lighting device according to claim 16, wherein the printed circuit board is a metal printed circuit board formed of a metal.

18. A lighting device for a refrigerator, comprising:

at least one light emitting diode module disposed on a front surface of a cold air duct at a predetermined side of a storage room of the refrigerator, the light emitting diode module being configured to emit light in at least one direction with respect to a front side of the storage room;

at least one light emitting diode cover configured to cover the light emitting diode module and transmit light emitted from the light emitting diode module toward an inside area of the storage room;

at least one reflector at the front surface of the cold air duct, the reflector being configured to reflect light emitted from the light emitting diode module toward the inside area of the storage room; and at least one installation member fixed to the predetermined side of the storage room, wherein the light emitting diode module is disposed between the installation member and the light emitting diode cover.

* * * * *